US007905624B2

(12) United States Patent
Bushee et al.

(10) Patent No.: US 7,905,624 B2
(45) Date of Patent: Mar. 15, 2011

(54) TACTICAL FLASHLIGHT

(76) Inventors: Glenn Bushee, Duxbury, MA (US); Jonathan Neal, Kingston, MA (US)

( * ) Notice: Subject to any disclaimer, the term of this patent is extended or adjusted under 35 U.S.C. 154(b) by 391 days.

(21) Appl. No.: 12/075,915

(22) Filed: Mar. 14, 2008

(65) Prior Publication Data

US 2008/0291666 A1 Nov. 27, 2008

Related U.S. Application Data

(60) Provisional application No. 60/931,437, filed on May 23, 2007.

(51) Int. Cl.
*F21L 4/04* (2006.01)

(52) U.S. Cl. ..... 362/206; 362/109; 362/119; 362/202; 362/208

(58) Field of Classification Search ..... 362/102, 362/109, 119, 120, 202, 206, 208
See application file for complete search history.

(56) References Cited

U.S. PATENT DOCUMENTS

D513,334 S * 12/2005 Galey ..... D26/37
D532,138 S * 11/2006 Wang et al. ..... D26/49
D544,621 S * 6/2007 Kim ..... D26/37
7,281,815 B1 * 10/2007 Gustafson et al. ..... 362/206

* cited by examiner

*Primary Examiner* — Stephen F Husar

(57) ABSTRACT

A sturdy compact flashlight has a front castellated crown portion having a series of recessed sharp cutting edges spaced between a series of axial projections which protect the flashlight lens. The cutting edges can be used to stun an assailant in an emergency situation. A rear castellated crown portion has a series of sharp pointed striking corners designed to break through automotive glass in an emergency. The flashlight is designed for ergonomic one-handed operation with a slip-resistant hand grip.

9 Claims, 3 Drawing Sheets

FIG 1
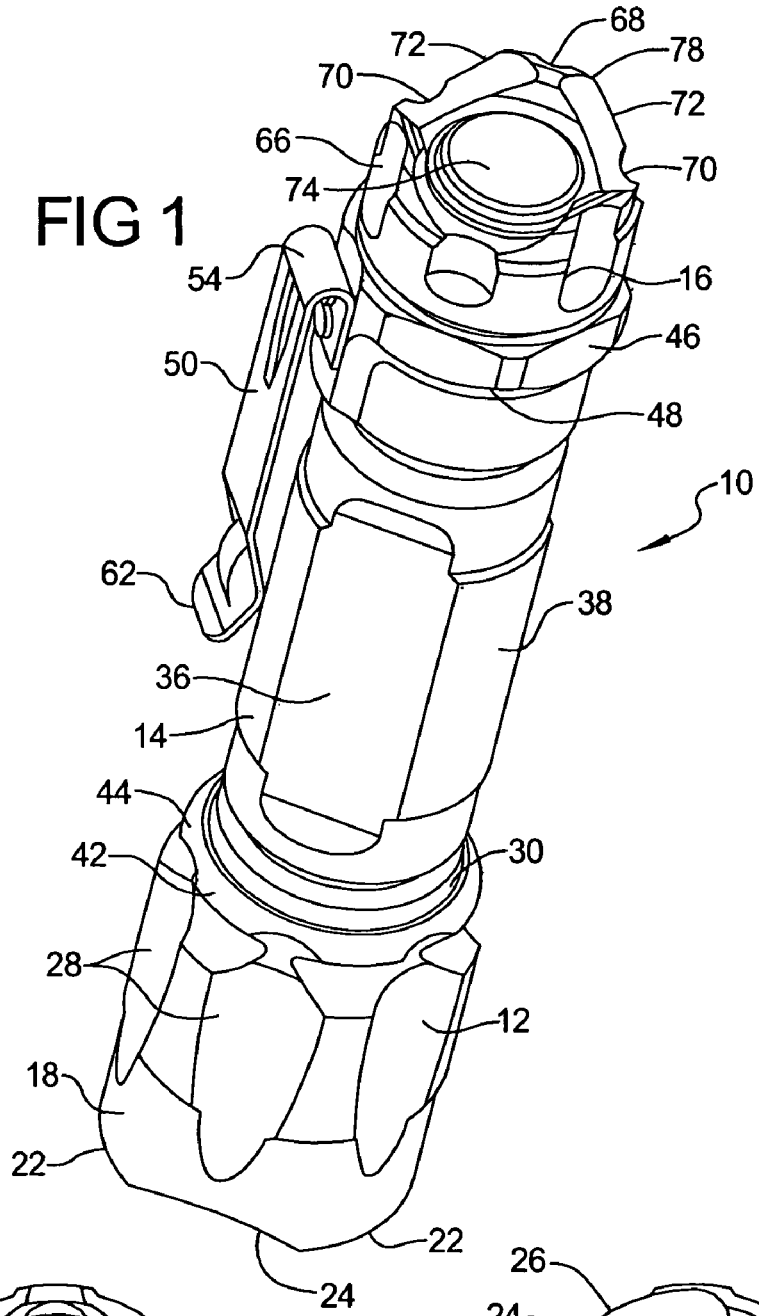
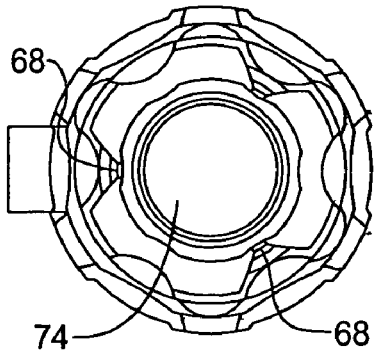
FIG 6
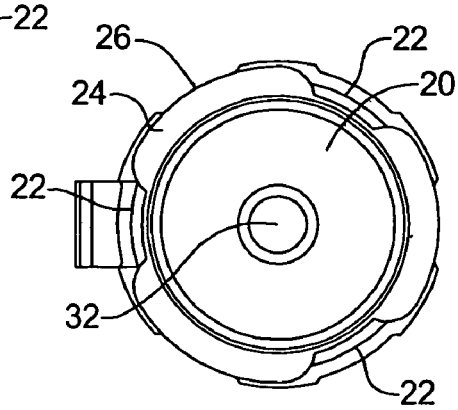
FIG 7

TACTICAL FLASHLIGHT

CROSS REFERENCE TO RELATED APPLICATIONS

This application is related to U.S. patent application Ser. No. 29/286,938 filed May 23, 2007 and now U.S. D554,281. This application claims the benefit and priority of U.S. Provisional Patent Application No. 60/931,437 filed May 23, 2007, entitled Tactical Flashlight and is incorporated herein in its entirety by reference. This application is also related to U.S. Pat. No. 7,604,371.

BACKGROUND

Field

The present disclosure relates to a compact, heavy-duty flashlight adapted for self defense and emergency situations.

Summary

An ergonomic multi-purpose flashlight is machined from high strength aluminum alloy for use in tactical, emergency and self defense situations. Specially configured front end and rear end housing portions are adapted for stunning an attacker and for breaking through window glass, such as may be required to escape from an auto after a collision.

The front crown of the flashlight housing is contoured with a stepped, wavy or crenulated front edge portion defined by alternating flat leading edge portions and sharp chisel-edged recessed arcuate portions.

The flat leading edge portions allow the flashlight to stand upright when placed on a flat surface and serve as a protective shield for the glass lens recessed within the front crown. The recessed sharp edge portions can be used as a self defense tool to strike and stun an attacker.

Because the glass lens is axially recessed about one quarter inch from the flat leading edge portions and about one eighth inch from the bottom or trough of the recessed edge portions, the front crown acts as both a light shade to protect a user's eyes from the bright light beam and as a collimator to further focus the light beam. The protective light-shading effect of the crown is particularly useful to law enforcement officers when wearing the flashlight on a shoulder epaulet.

The rear end portion or base of the housing is also contoured with a stepped, wavy or crenulated rear edge portion defined by alternating flat base edge portions and sharp-edged arcuate recessed portions. The lateral edges or corners of the flat base end portions are formed as strong sharp points which are well adapted for breaking through glass.

An on-off switch is axially recessed in the base or rear end of the housing so that the flat end base portions extend axially beyond the axial end surface of the on-off switch. This allows the flashlight to stand upright on the flat base edge portions without interference from the switch. This also and protects the switch from accidentally being depressed and prevents unintended illumination of the flashlight and unintended battery drain.

The on-off switch is arranged in the housing base so that it extends axially rearwardly beyond the bottom or trough of the sharp-edged arcuate recessed portions in the base of the housing. This allows a user to easily access and depress the switch through the sharp-edged recessed portions using a single finger or thumb and using a single-handed operation.

A removable, replaceable and interchangeable steel spring clip is attached to the housing. Removable fasteners such as screws or bolts can be used for this purpose. The free end of the clip has a wide open mouth to accommodate thick clothing, including belts and epaulets common to law enforcement uniforms.

The central body portion of the housing is provided with flat planar surface portions circumferentially-spaced between cylindrical surface portions. The cylindrical surface portions can be checkered or knurled or otherwise contoured to provide a secure non-slip gripping surface. The clip is axially aligned over one of the cylindrical surface portions so as to act as a guide for circumferentially guiding a user's fingers onto an adjacent flat planar surface portion.

The axial and circumferential locations of the flat planar surface portions, the cylindrical portions and the clip, together provide a stable self-centering ergonomic grip. Moreover, the front and rear end portions of the housing are provided with one or more radially-extending annular ridges or steps which provide a guide for axially locating a user's hand symmetrically around the ergonomic central grip portion of the housing.

The location of the central grip portion and the relative location of the recessed switch in the rear end portion of the housing allows the flashlight to be used effectively with one hand. A user can depress the switch with a light thumb pressure to momentarily turn on the flashlight. Release of thumb pressure will allow the switch to open and turn off the flashlight. In this mode of operation, the switch is normally off and does not latch on.

By applying significantly greater thumb pressure, the switch will latch on and stay on after thumb pressure is released. The switch must then be depressed again with significant thumb pressure to turn the flashlight off. The switch may also be adapted to provide high and low beam power, as well as a strobe setting.

Various other objects, features and attendant advantages of the present embodiments will be more fully appreciated as the same becomes better understood from the following detailed description when considered in connection with the accompanying drawings, in which like reference characters designate like or corresponding parts through the several views.

BRIEF DESCRIPTION OF THE DRAWINGS

In the drawings:

FIG. 1 is a top right rear perspective view of a flashlight constructed in accordance with an embodiment of the disclosure;

FIG. 6 is a rear elevation view of the flashlight; and

FIG. 7 is a front elevation view of the flashlight.

In the various views, the same reference numerals designate the same or similar parts.

DESCRIPTION OF THE EMBODIMENTS

Figure 2:
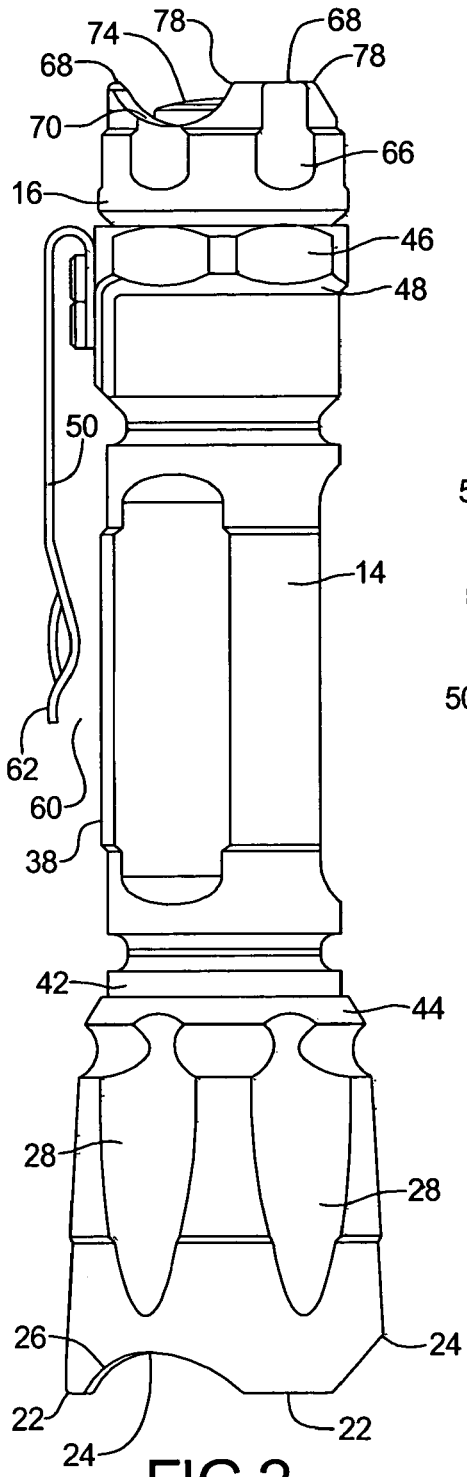
FIG. 2 is a right side elevation view of the flashlight.

As seen in FIGS. 1-7, a tactical flashlight 10 includes a front end portion 12, a central portion 14 and a rear end portion 16. The front end portion 12 includes an annular crown or bezel portion 18 which surrounds and protects a transparent glass or plastic lens 20 (FIG. 7). Lens 20 is axially recessed within the crown 18 for protection such as when the flashlight 10 is used as a striking implement for self-defense.

Crown 18 is formed with circumferentially-spaced flat end portions 22 which allow the flashlight to be stood axially face-down on a flat surface. Symmetrically and circumferentially-spaced between flat axially-projecting end portions 22 is a series of axially-recessed sharp-edged arcuate recesses 24. Each recess 24 has a sharp, chisel-edged beveled outer arcuate or U-shaped surface cutting edge 26 which can be used for striking and stunning an assailant.

A series of relatively large axially-extending bullet-shaped grooves 28 is formed in the outer sidewall of the front end portion 12. Grooves 28 provide a secure gripping surface for allowing the internally-threaded front end portion 12 to be hand-screwed on and off a front tubular threaded sleeve 30 on the front end of the central portion 14. Removal of the front end portion 12 allows access to and replacement of the light-emitting diode (LED) light source 32 (FIG. 7).

Figure 3:
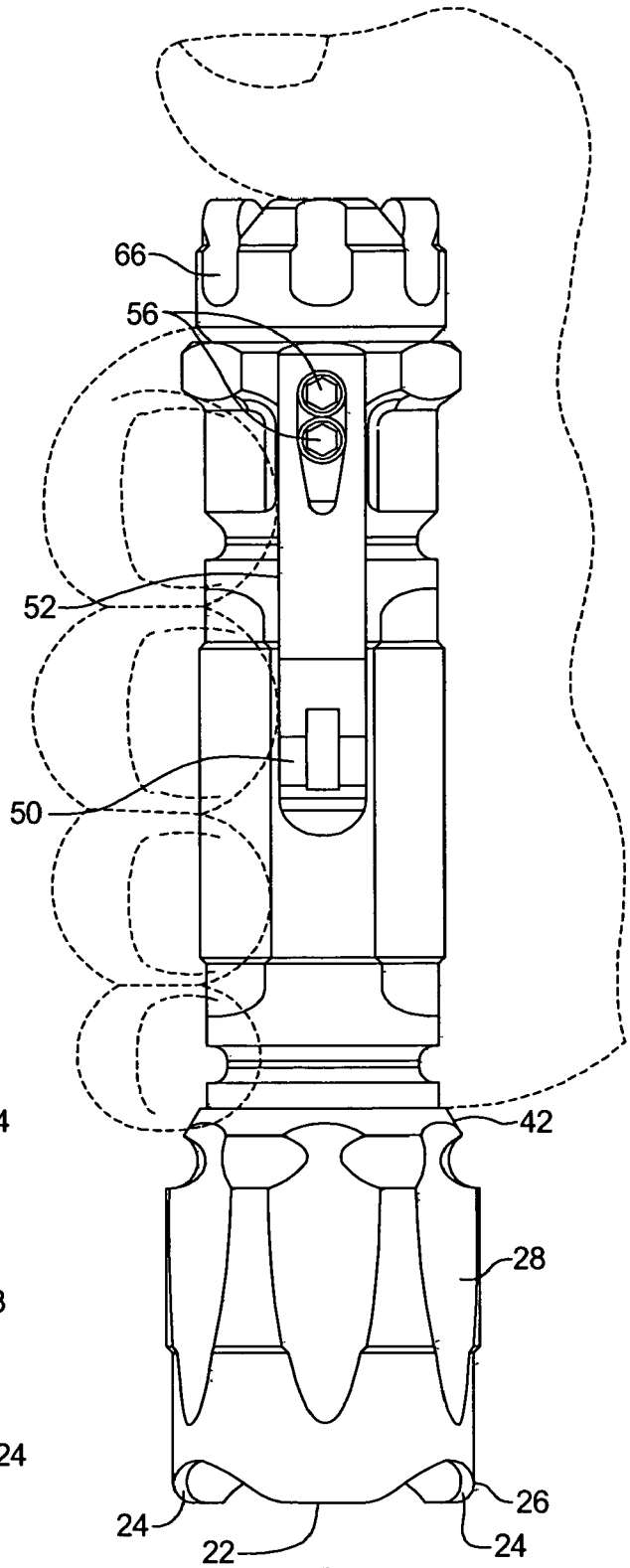
FIG. 3 is a top plan view of the flashlight.

The tubular central gripping portion 14 is formed with a circumferentially-spaced series of three flat planar outer surface portions 36, symmetrically spaced between a series of three cylindrical outer surface portions 38. The cylindrical outer surface portions 38 can be checkered, ribbed, grooved or knurled to provide a non-slip gripping surface. As seen in FIG. 3, the axial length of the central portion 14 can, in one example, be about two to two-and-one-half inches long so as to snugly and securely receive and position four smaller fingers tightly on the flashlight 10 and, in another example, from two inches to up to four inches long to snuggly and securely receive and position four larger fingers tightly on the flashlight 10.

The rear end 42 of the front end portion 12 forms an annular radial step or front radial abutment 44 against which a user's small finger naturally rests as shown in FIG. 3. The rear end 46 of the central portion 14 forms an annular radial step or rear radial abutment 48 against which a user's index finger naturally rests. The smaller diameter or cross section of the central portion 14 is axially bounded on opposite ends by the larger diameters or cross sections of the radial abutments 44, 48 which extend radially-outwardly from the central portion 14. In this manner, one's hand is easily and comfortably positioned and aligned in an ergonomic grip on and around flashlight 10, and one's thumb is positioned for quick and easy actuation of the on-off switch, as discussed below.

The radial ridges or abutments 44, 48 also axially anchor one's hand on the flashlight 10. This is particularly advantageous when the flashlight is used as a striking tool, as the ridges or abutments 44, 48 prevent one's hand from slipping and sliding axially both forwardly and rearwardly when striking with the front end portion 12 or the rear end portion 16.

Additional hand alignment is provided by mounting a heavy-duty spring clip 50 over one of the cylindrical surface portions 38. As seen in FIG. 3, the side edge 52 of spring clip 50 provides a longitudinally-extending abutment against which one's finger tips naturally engage and rest. This abutment positions one's finger pads along one of the adjacent flat planar outer surface portions 36 for a secure ergonomic grip.

The base 54 of spring clip 50 is removably attached to the rear end 46 of the central portion 14 by threaded fasteners 56 which are engaged in tapped bores in central portion 14. The clip opening or mouth 60 formed between the free end 62 of spring clip 50 and the underlying cylindrical surface portion 38 is enlarged to accept thick fabrics, epaulets and belts. Opening 60 in its free unbiased at-rest position can extend radially above the central portion 14 from about one-eighth to one quarter inch.

The rear end portion 16 includes a front threaded cylindrical portion which is threaded into screw threads formed in the inner wall of the rear end 46 of the central portion 14. This allows access to one or more removable standard batteries or one or more lithium batteries housed within the central portion 14. The outer surface of end portion 16 can be checkered or knurled to facilitate gripping and screwing the rear end portion 16 into and out of the central portion 14. Deep grooves or recesses 66 provide an even greater grip for this purpose.

Rear end portion 16 is formed with a series of flat axially-extending end wall portions 68 which allow the flashlight 10 to stand upright on a flat surface. Circumferentially-spaced evenly between the flat end portions 68 is a series of sharp-edged arcuate recesses 70 which form a wave-like or undulating peripheral wall around the rear end portion 70. Each recess 70 has a sharp outer edge 72. The recesses 70 and end wall portions 68 form a crenulated or castellated crown-shaped peripheral wall that surrounds an axially-movable on-off thumb switch 74.

The flat end wall portions 68 extend axially rearwardly about one-sixteenth to one-eighth inch beyond the top end of switch 74 to protect the switch 74 from accidental actuation. The front or bottom end portions 75 (FIG. 5) of the recesses 70 extend axially forwardly about one-sixteenth to one-eighth inch beyond the top end of switch 74 to provide convenient thumb access to the switch 74. In this arrangement, the top or rear end of the switch is located axially between the flat end portion 68 and the bottom 75 of recesses 70.

The ends or corners 78 of each flat end wall portion 68 are pointed to provide a series of strong rigid striking points. These corners 78 or points are particularly well adapted to strike and break glass, such as automotive window glass.

Figure 4:
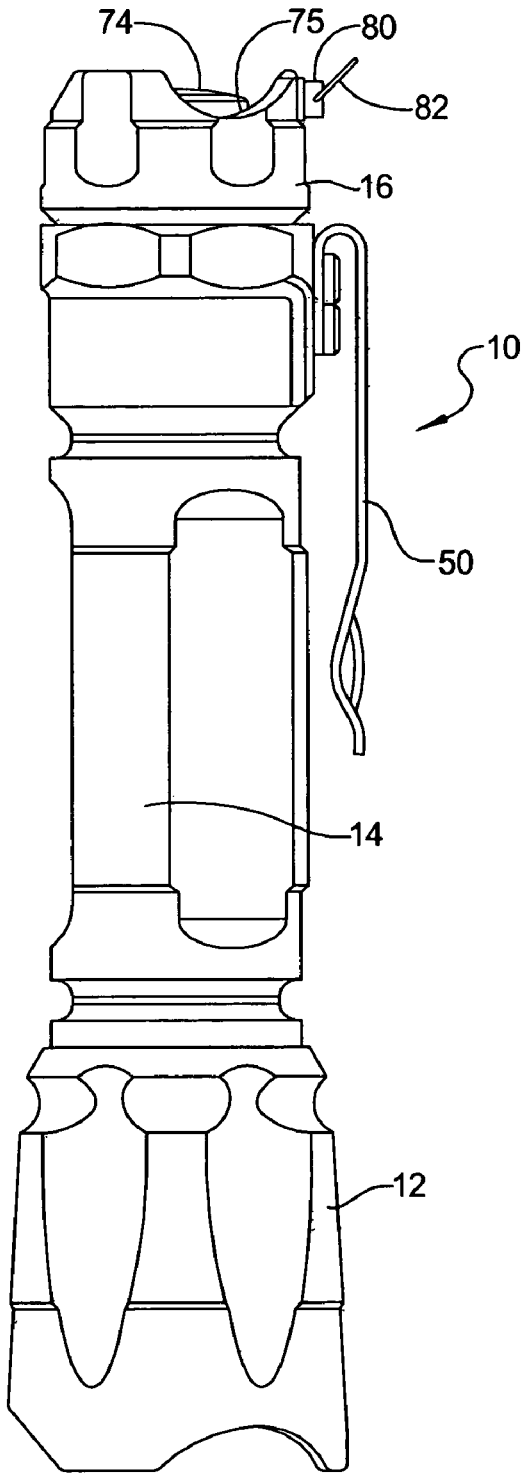
FIG. 4 is a left side elevation view of the flashlight.
Figure 5:
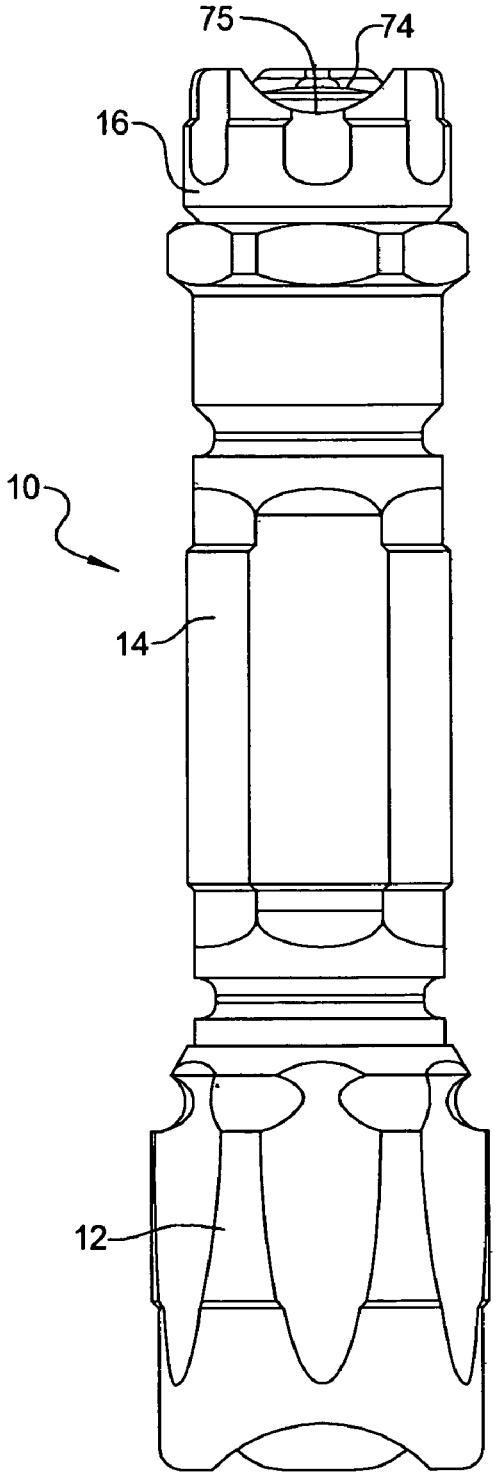
FIG. 5 is a bottom plan view of the flashlight.

As seen in FIG. 4, an anchor post 80 can be screwed into a tapped hole in the outer wall of the rear end portion 16 for receiving a pivoting circular clip or ring connector 82. Connector 82 can be used to clip the flashlight 10 to a key chain, lanyard or other attachment.

There has been disclosed heretofore the best embodiment of the disclosure presently contemplated. However, it is to be understood that various changes and modifications may be made thereto without departing from the spirit of the invention.

What is claimed is:

1. A flashlight, comprising:

a front end portion, a rear end portion, and a central portion interconnecting said front and rear end portions;

said front end portion having a plurality of circumferentially-spaced arcuate sharp edge portions; and a plurality of recesses formed in said front end portion and said rear end portion, said recesses in said front end portion defining said sharp edge portions.

2. The flashlight of claim 1, wherein said front end portion further comprises a plurality of flat end portions located between said sharp edge portions.

3. The flashlight of claim 1, further comprising a spring clip removably mounted to said flashlight.

4. The flashlight of claim 1, wherein said central portion comprises a finger grip portion located between a pair of radially-outwardly extending abutment portions.

5. The flashlight of claim 1, further comprising an on-off switch recessed within said rear end portion.

6. A flashlight, comprising:

a front end portion, a rear end portion and a central portion interconnecting said front and rear end portions along an axis;

said rear end portion comprising a peripheral wall having a plurality of recesses formed therein and a plurality of end wall portions located between said recesses, said recesses each having a front end portion; and a switch mounted on said rear end portion and having a top end located axially between said end wall portion and said forward end of said recesses.

7. The flashlight of claim 6 wherein said switch comprises and axially-movable on-off switch.

8. The flashlight of claim 6, wherein said peripheral wall comprises a castellated wall.

9. The flashlight of claim 6 wherein each of said end wall portions comprises flat end wall portion.

* * * * *